US009273420B2

(12) United States Patent
Dilo

(10) Patent No.: US 9,273,420 B2
(45) Date of Patent: Mar. 1, 2016

(54) METHOD FOR ACTUATING A NEEDLE BAR IN A NEEDLING MACHINE

(71) Applicant: Oskar Dilo Maschinenfabrik KG, Eberbach (DE)

(72) Inventor: Johann Philipp Dilo, Eberbach (DE)

(73) Assignee: OSKAR DILO MASCHINENFABRIK KG, Eberbach (DE)

( * ) Notice: Subject to any disclaimer, the term of this patent is extended or adjusted under 35 U.S.C. 154(b) by 0 days.

(21) Appl. No.: 14/572,304

(22) Filed: Dec. 16, 2014

(65) Prior Publication Data

US 2015/0167216 A1 Jun. 18, 2015

(30) Foreign Application Priority Data

Dec. 17, 2013 (EP) ..... 13197633

(51) Int. Cl.
*D04H 18/02* (2012.01)

(52) U.S. Cl.
CPC ..... *D04H 18/02* (2013.01)

(58) Field of Classification Search
CPC ..... D04H 18/02; D04H 18/00
USPC ..... 28/114, 113, 107, 109, 110, 115
See application file for complete search history.

(56) References Cited

U.S. PATENT DOCUMENTS 2,974,393 A * 3/1961 Hollowell ..... D04H 18/02 28/107
5,732,453 A * 3/1998 Dilo ..... D04H 18/02 28/107
6,161,269 A * 12/2000 Dilo ..... D04H 18/02 28/107
2003/0000056 A1* 1/2003 Fehrer ..... D04H 18/00 28/247
2006/0288549 A1* 12/2006 Jean ..... D04H 18/02 28/107
2009/0119894 A1* 5/2009 Reutter ..... D04H 18/02 28/114
2010/0242240 A1* 9/2010 Reutter ..... D04H 18/02 28/107
2011/0047767 A1* 3/2011 Reutter ..... D04H 18/02 28/114
2012/0167361 A1* 7/2012 Reutter ..... D04H 18/02 28/107
2014/0310928 A1* 10/2014 Kuhl ..... D04H 1/46 28/110

FOREIGN PATENT DOCUMENTS

DE 1803342 A1 5/1970
DE 19615697 A1 3/1997
EP 1803342 A1 7/2007
WO 2006110575 A1 10/2006

OTHER PUBLICATIONS

English langauge machine translation of DE 1803342 as obtained from espacenet.com, DE Pubn Date May 21, 1970, translation 1 page.*

* cited by examiner

*Primary Examiner* — Amy Vanatta
(74) *Attorney, Agent, or Firm* — Jansson Munger McKinley & Kirby Ltd.

(57) ABSTRACT

A method for actuating a needle bar in a needling machine includes the actuation of a first oscillating drive at a first frequency, the first oscillating drive having a main conrod connected directly or indirectly to the needle bar, and simultaneously the actuation of a second oscillating drive at a second frequency, the second oscillating drive having a secondary conrod connected directly or indirectly to the needle bar, the movements of the needle bar produced by the first and second oscillating drives being superimposed on each other and the second frequency being higher than the first frequency.

14 Claims, 6 Drawing Sheets

METHOD FOR ACTUATING A NEEDLE BAR IN A NEEDLING MACHINE

CROSS REFERENCE TO RELATED APPLICATION

This application claims priority based on European patent application EP 10 175 847.2, filed Sep. 8, 2010.

FIELD OF THE INVENTION

The invention relates to methods for actuating a needle bar in a needling machine.

BACKGROUND OF THE INVENTION

The process of needling in a needling machine brings about the consolidation of a fiber fleece web being transported continuously through the needling machine. When the needle bar executes only a movement directed perpendicularly to the direction in which the fiber fleece web is moving, the forward movement of the continuously transported fiber fleece web is slowed by the needles during the phase of the needling cycle in which the needles are engaged in the fiber fleece web. This results in an undesirable distortion of the fiber fleece and to the cyclical occurrence of an elastic bending of the needles.

As a remedy for these disadvantageous effects, in U.S. Pat. No. 5,732,453 a second drive is assigned to the needle bar, which makes the needle bar oscillate parallel to the fiber fleece web (horizontal movement) cyclically and in synchrony with the stitching movement perpendicular to the fiber fleece (vertical movement). This horizontal movement proceeds in and opposite to the transport direction of the fiber fleece web through the needling machine. The timing of the horizontal movement is superimposed on the vertical stitching movement of the needle bar in such a way that, during the phase of each movement cycle in which the needles are engaged in the fiber fleece, the movement of the needle bar in the horizontal direction follows the forward movement of the fiber fleece through the needling machine, whereas, in the state in which the needles are disengaged from the fleece, the needle bar returns in the horizontal direction back to the starting position. When viewed from the side, transversely to the transport direction of the fiber fleece web, therefore, the needle bar executes a gyrating movement, which is more-or-less circular or elliptical depending on the ratio between the horizontal stroke and the vertical stroke.

As a further improvement to this solution, a mechanical attachment is proposed in U.S. Pat. No. 6,161,269, by means of which the horizontal movement of the needle bar is easily adjustable in small increments, preferably in a continuously variable fashion.

Common to all of the approaches described above is that the vertical movement and the horizontal movement of the needle bar are synchronized with each other. In other words, the needle bar moves up and down in the vertical direction precisely during the period in which the needle bar is moving back and forth in the horizontal direction.

It is an object of the present invention to provide a method for actuating a needle bar in a needling machine by means of which the fiber fleece can be transported through the needling machine at a higher speed and/or by means of which a larger number of stitches can be produced in the fiber fleece.

SUMMARY OF THE INVENTION

According to an aspect of the invention, the method for actuating a needle bar in a needling machine comprises the steps of: actuating a first oscillating drive, which includes a main conrod connected directly or indirectly to the needle bar, at a first frequency; and simultaneously actuating a second oscillating drive, which includes a secondary conrod connected directly or indirectly to the needle bar, at a second frequency, in such a way that the movements of the needle bar produced by the first oscillating drive and the second oscillating drive are superimposed. The second frequency is higher than the first frequency.

With this configuration, it is possible to move the needle bar and thus the fiber fleece web a considerable distance forward during each stroke, whereas simultaneously, during one of these large horizontal strokes, each needle can execute several vertical stitches into the fiber fleece web. As a result, the fiber fleece web can be transported at high speed without the need to make a significant reduction in the stitch density in the fiber fleece web.

In a preferred embodiment, the main conrod is oriented substantially horizontally. In this way, the main conrod can produce a considerable forward horizontal advance without any special mechanical add-ons. It is also conceivable that the main conrod could be connected directly or indirectly to other mechanical assemblies or that the main conrod could be oriented at a certain angle.

The first oscillating drive is preferably an eccentric drive, and the horizontal stroke component of the center of gravity of the needle bar produced by the first oscillating drive is at least 25% greater, more preferably at least 50% greater, and even more preferably at least 75% greater than the vertical stroke component of the center of gravity of the needle bar brought about by the first oscillating drive. This guarantees that the horizontal advance of the fiber fleece web during a stroke of the first oscillating drive exceeds the value of the associated vertical stroke by a certain minimum amount. As a result, the movement of the first oscillating drive causes the center of gravity of the needle bar to follow a path substantially in the form of a horizontal ellipse. The greater the percentage difference, the flatter the shape of the ellipse. It is also important here, however, that a certain upper limit of approximately 500-1,000% not be exceeded, because the needles of the needle board fastened to the needle bar must be disengaged from the fiber fleece web during the return stroke, i.e., in the area of the upper section of the curved elliptical path.

The first frequency is preferably in the range of 500-2,500 strokes per minute, more preferably in the range of 1,000-2,000 strokes per minute. In combination with the relatively large forward movement of the fiber fleece in the horizontal direction of about 80-240 mm per movement cycle (i.e., during a forward and return movement of the main conrod), this relatively low stroke frequency nevertheless leads to a fast transport speed of the fiber fleece.

In a preferred embodiment, the secondary conrod is aligned substantially in the vertical direction. In this way, the vertical up-and-down movements of the needle bar which the secondary conrod is intended to produce are especially easy to achieve without the need for any additional mechanical components.

The second frequency is preferably in the range of 2,000-10,000 strokes per minute, and more preferably in the range of 2,000-4,000 strokes per minute (as long as it is higher than the first frequency, preferably at least 100% higher, more preferably at least 200% higher, and even more preferably at least 300% higher). This guarantees that the second frequency is so high that, per forward horizontal movement, the needles can execute at least two, preferably at least three or even more, stitches into the fiber fleece web.

A second vertical stroke component of the center of gravity of the needle bar produced by the second oscillating drive is preferably at least 20% smaller, more preferably at least 30% smaller, and even more preferably at least 40% smaller than the first vertical stroke component of the center of gravity of the needle bar produced by the first oscillating drive. This guarantees that, in the area of the horizontal return stroke, the needles remain disengaged from the fiber fleece in spite of the vertical up-and-down movement produced by the second oscillating drive.

Thanks to the superimposition of the two movements produced by the first oscillating drive and the second oscillating drive, the center of gravity of the needle bar preferably follows, during the course of a stitching cycle, a path which comprises substantially the basic form of a horizontal ellipse upon which smaller sinusoidal peaks and valleys are additionally superimposed along the long sides. In this way, several stitches per horizontal forward movement of the needle bar can occur in the lower area of the elliptical path, whereas, during the horizontal return stroke of the needle bar, the needles remain disengaged from the fiber fleece in spite of the small sinusoidal peaks and valleys of the curved path.

According to another aspect of the invention, a method for operating a needling machine comprises the steps of: actuating at least one needle bar according to the previously described method, wherein at least one needle board is attached to the needle bar; and transporting a card web or fiber fleece through the needling machine at a speed of at least 100 m/min, preferably of at least 200 m/min, and more preferably of at least 300 m/min. The transport speeds of the fiber fleece achieved here are above the conventional speed without the occurrence of any significant defects in the stitching pattern of the needled fleece.

To increase the stitch density, the needle board can preferably comprise a needle density of at least 15,000 needles per meter of board length, and more preferably of at least 20,000 needles per meter of board length.

So that there is no need to deal with limitations involving the very large horizontal forward movement per stroke of the needle bar, a brush belt, on which the carded web or fleece rests, is preferably used as a substrate for the card web or the fleece to be needled in place of the otherwise conventional stitch plate.

For the same reasons, it can be preferable for the card web or fleece being transported through the needling machine to be held down during the needling process by wires stretched across the brush belt.

BRIEF DESCRIPTION OF THE DRAWINGS

Additional features and advantages of the present invention can be derived from the following description, which refers to the drawings.

DETAILED DESCRIPTION OF SPECIFIC EMBODIMENTS

Figure 1:
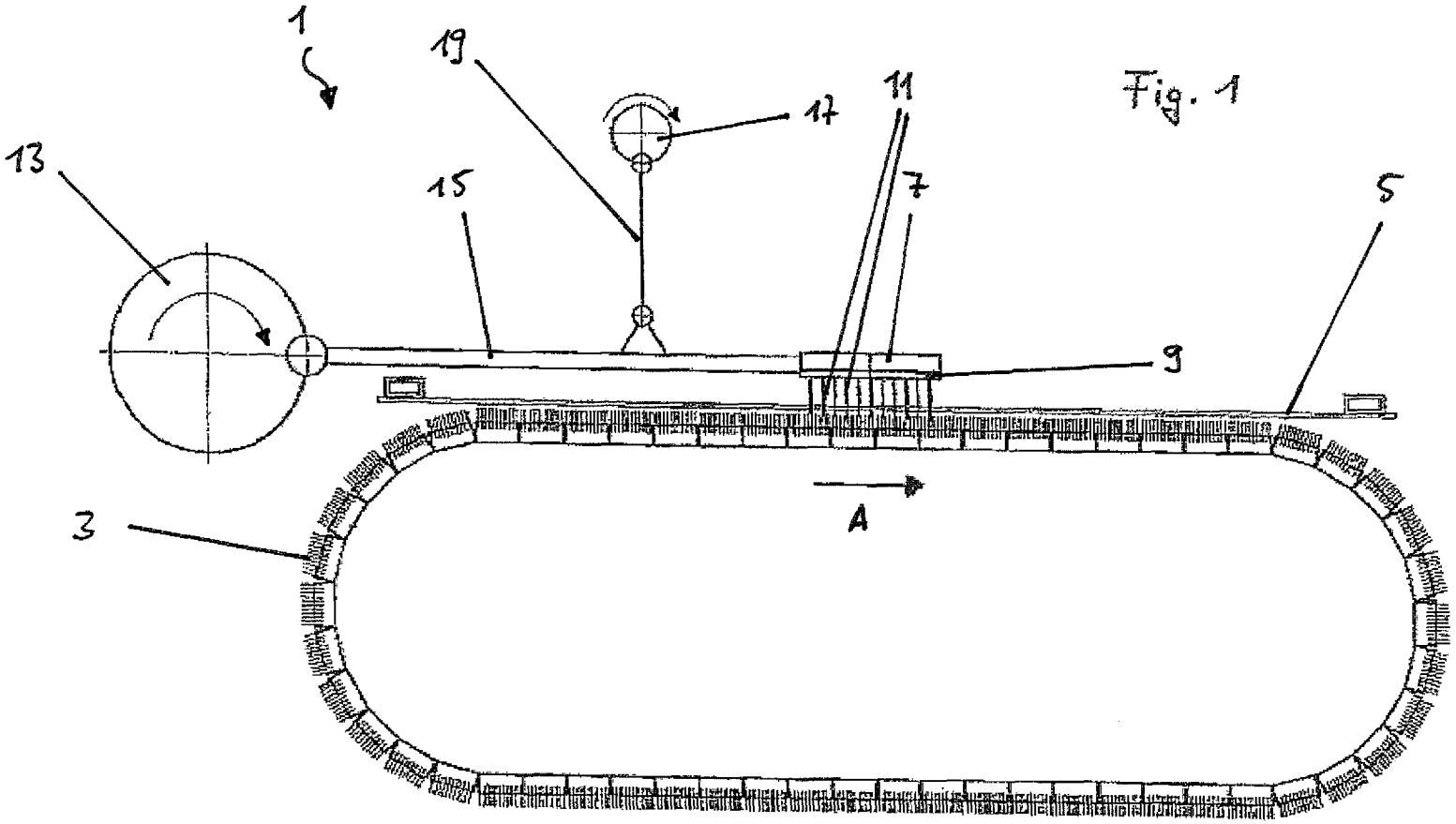
FIG. 1 shows a schematic diagram of a needling machine comprising a needle bar, which can be actuated according to the method according to the invention.

FIG. 1 shows a schematic diagram of a needling machine 1 on a very high level of abstraction. In needling machine 1, a card web or fiber fleece (not shown in FIG. 1) is moved in transport direction A on a brush belt 3, which is driven continuously by suitable drives (not shown). The card web or fiber fleece rests on the upper run of brush belt 3 and is preferably held down from above by wires 5, which are stretched over brush belt 3 and extend in the transport direction A. In place of brush belt 3, some other conventional drive can be used for the fiber fleece. Thus the fiber fleece can be conducted, for example, over a stitching plate provided with longitudinal slots. In place of wires 5, conventional hold-downs with corresponding openings extending in the longitudinal direction can also be used. Brush belt 3 and wires 5, however, offer the advantage of giving the needle bar 7 greater freedom of movement in the transport direction A of the fiber fleece, as will be explained in greater detail below.

Needle bar 7 carries at least one needle board 9, in which a large number of needles 11 are arranged. The needle board 7 is driven by a first oscillating drive 13, which comprises a main conrod 15. In addition, a second, primarily vertical movement is superimposed on this first movement. The vertical movement is produced by a second oscillating drive 17, which comprises a secondary conrod 19.

By "oscillating drive" is meant both a drive which brings about a back-and-forth movement of the needle bar in only one direction and also a drive which combines a back-and-forth movement of the needle bar in a first direction together with a movement in the direction perpendicular to that (e.g., actuation by a crank disk).

The details of the drive mechanism for needle bar 7 shown in FIG. 1 will now be described more completely with reference to FIG. 2. In this embodiment, first oscillating drive 13 is an eccentric drive and, in the exemplary driven embodiment shown here, it comprises not only main conrod 15 but also a crank disk 21, which is in rotation and on which is mounted an off-center crank pin 22, which in turn is rotatably connected to main conrod 15. The other end of conrod 15 is rigidly connected to needle bar 7. Main conrod 15 is oriented substantially horizontally. It is also preferably relatively long, for the ratio between the length of main conrod 15 and the eccentricity of the drive determines the degree to which needle bar 7 will tilt—which is undesirable—during a stitching cycle.

In the embodiment shown, second oscillating drive 17 is also an eccentric drive and comprises a crank disk 23 and a crank pin 25 mounted on it in an off-center position. Crank pin 25 orbits around the center of crank disk 23 when the disk rotates. Secondary conrod 19 is in turn attached rotatably to crank pin 25 and is arranged substantially perpendicularly above main conrod 15. Secondary conrod 19 is connected at its bottom end to main conrod 15 by way of a rotary joint 29. The connecting point between secondary conrod 19 and main conrod 15 is located in an area of main conrod 15 which is relatively close to needle bar 7 (for example, in the forward one-fourth or forward one-third of main conrod 15). Secondary conrod 19 is considerably shorter than main conrod 15. Crank disks 21, 23 of first oscillating drive 13 and second oscillating drive 17 are both driven in the same rotational direction. First oscillating drive 13 is driven at a first frequency, and second oscillating drive 17 is driven at a second frequency. The second frequency is always higher, preferably much higher, than the first frequency.

By way of example, the first frequency is in the range of 500-2,500 strokes per minute, and preferably in the range of 1,000-2,000 strokes per minute. In contrast, the second frequency is preferably in the range of 2,000-10,000 strokes per minute, and more preferably in the range of 2,000-4,000 strokes per minute. This also applies to all of the embodiments of the drive mechanism described in the following.

Figure 2:
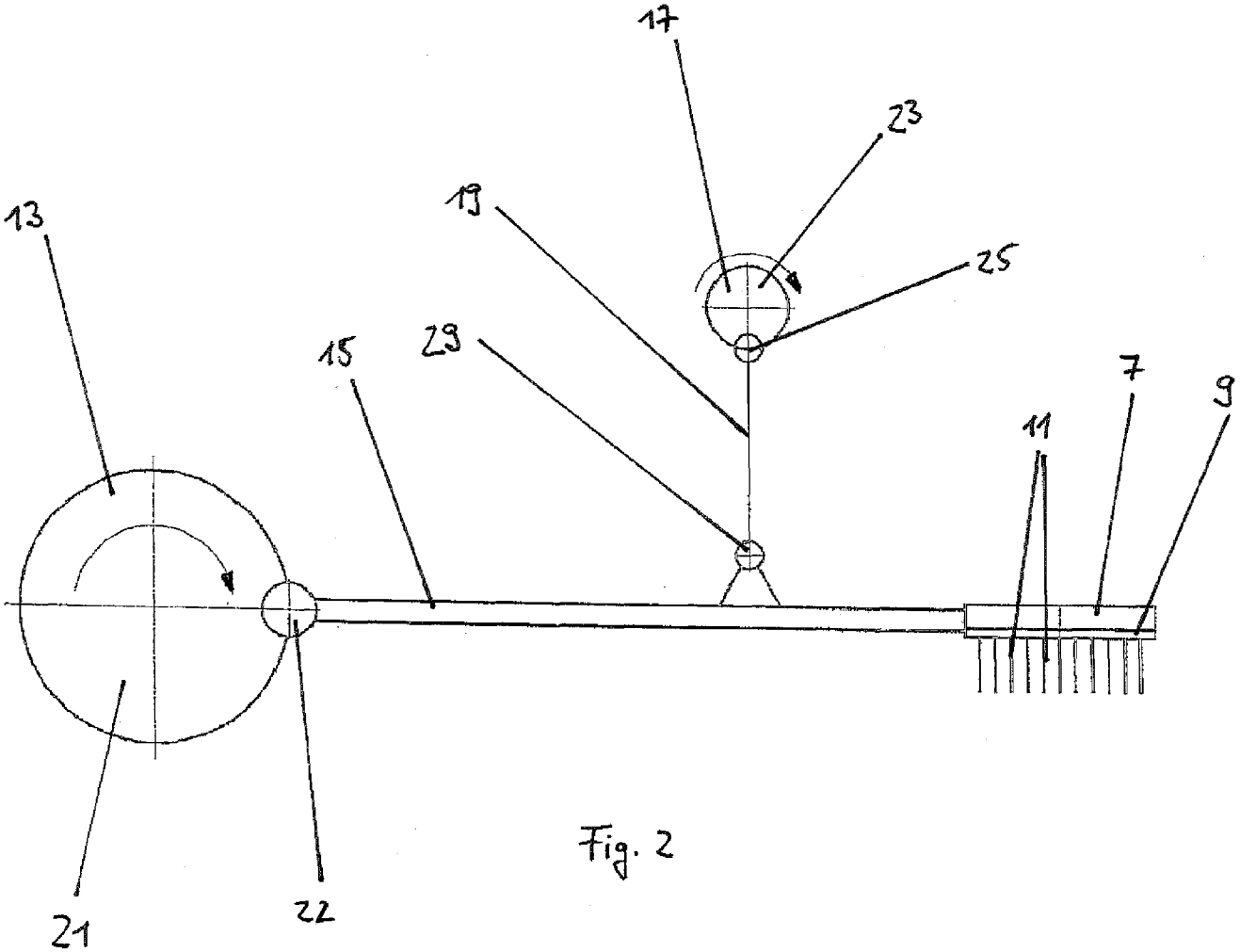
FIG. 2 shows an enlarged schematic diagram of the drive mechanism of the needle bar of FIG. 1.

In the embodiment of FIG. 2 and in all of the other embodiments, furthermore, the stroke produced by first oscillating drive 13 is considerably greater than the stroke produced by second oscillating drive 17.

Overall, it is therefore guaranteed that the movements of needle bar 7 produced by first oscillating drive 13 and second oscillating drive 17 are superimposed on each other. First oscillating drive 13 creates the basic form of the path traveled by a center of gravity of needle bar 7, whereas the smaller movements of the center of gravity of needle bar 7 produced by second oscillating drive 17 result in modulations of this basic form of the path of movement. This will be explained in greater detail on the basis of FIGS. 6 and 7.

In addition to the particular configuration of first oscillating drive 13 and of second oscillating drive 17 shown in FIGS. 1 and 2, there are also many other configurations which could be used. The person skilled in the art will be able to indicate a whole series of alternatives leading to the same functionality. Examples of this would be other types of eccentric drives such as eccentric shafts, slider cranks, camshafts, or eccentric plungers with return springs. It would also be possible to use hydraulically oscillating drives or pneumatically oscillating drives especially as second oscillating drive 17.

Figure 3:
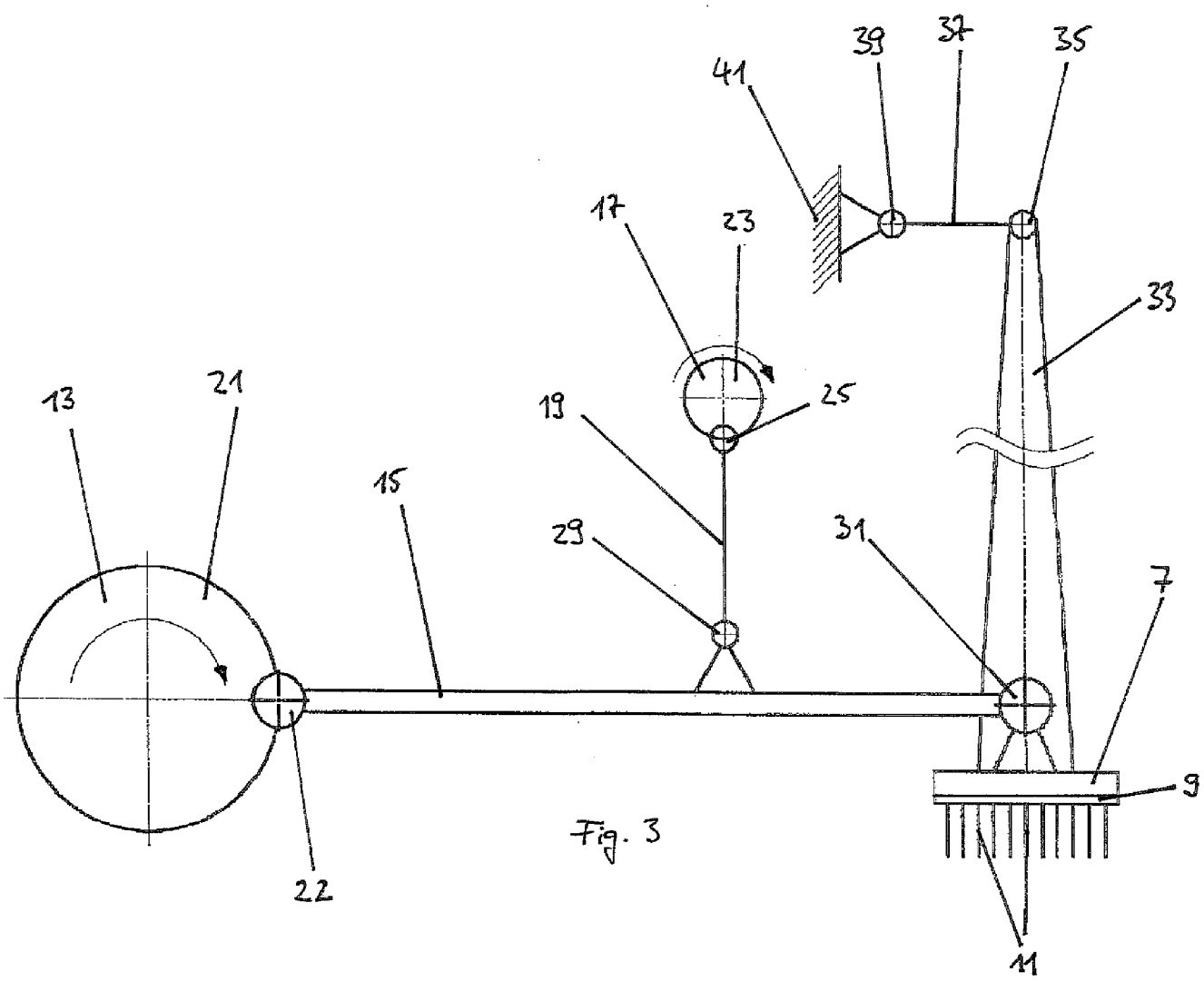
FIG. 3 shows a schematic diagram of another drive mechanism which can be used to actuate a needle bar according to the invention.
Figure 4:
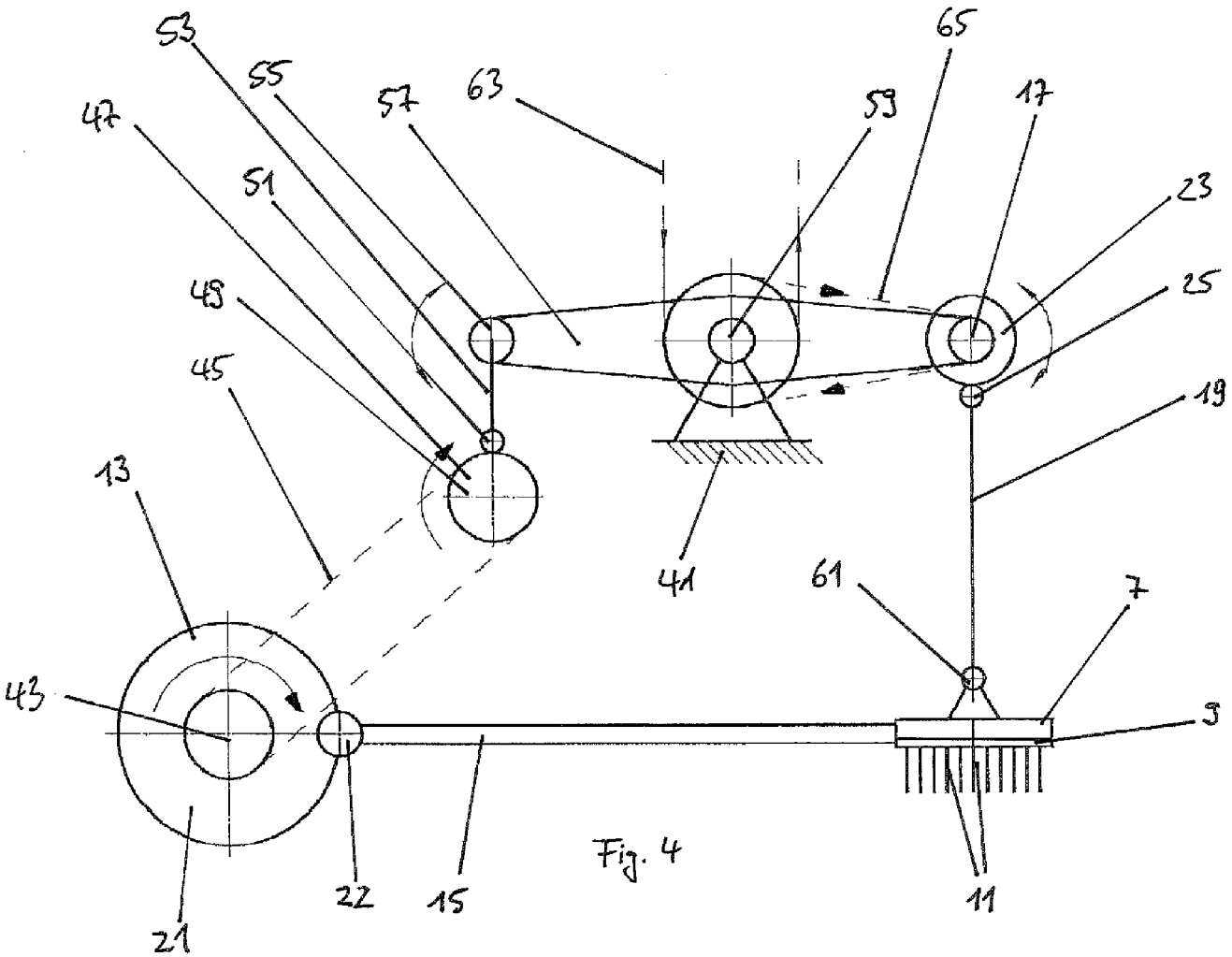
FIG. 4 shows a schematic diagram of another drive mechanism which can be used to actuate a needle bar according to the invention.
Figure 5:
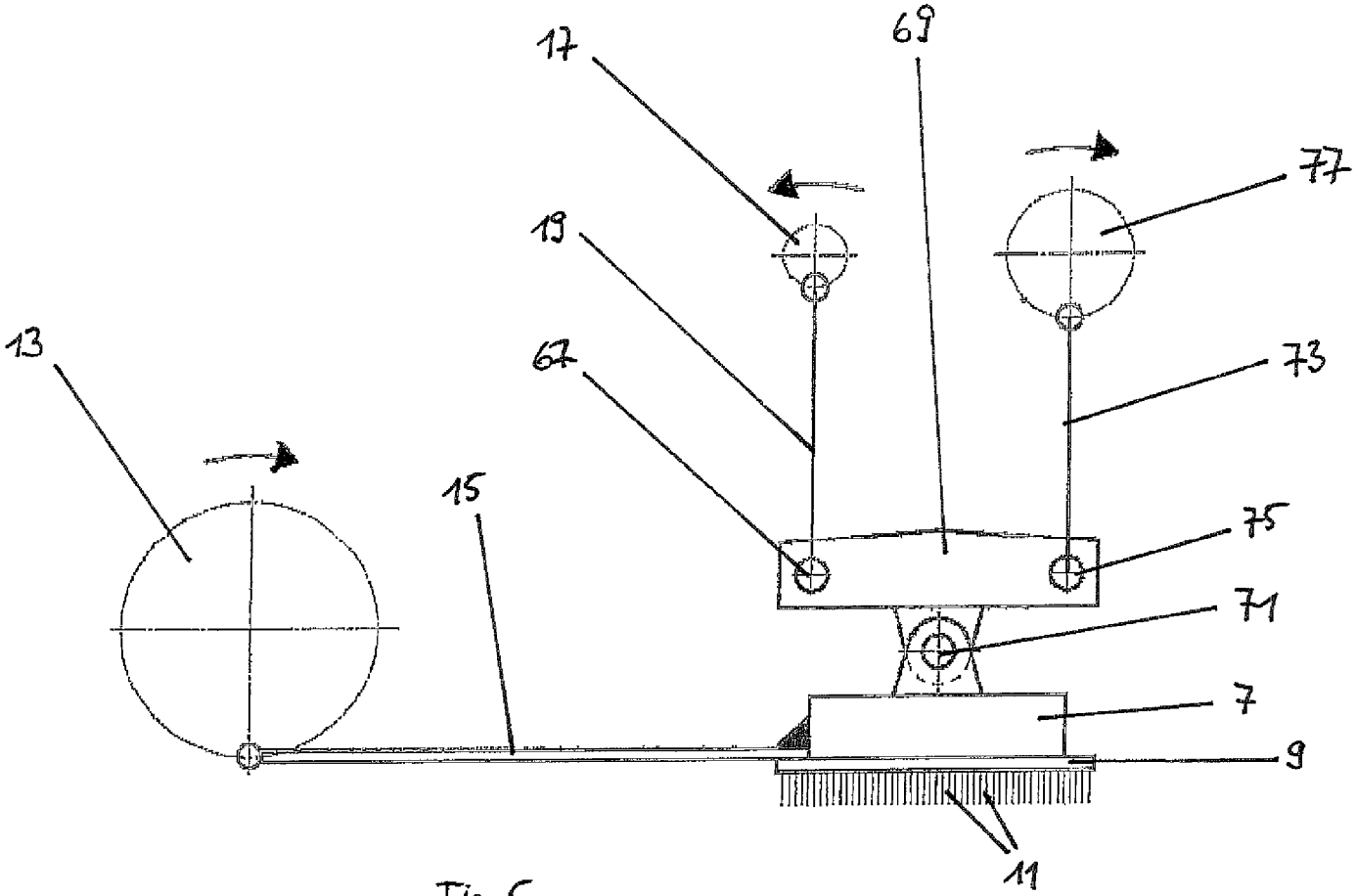
FIG. 5 shows a schematic diagram of another drive mechanism which can be used to actuate a needle bar according to the invention.

In comparison to the embodiment of FIG. 2, the embodiments of the drive mechanism of needle bar 7 described in FIGS. 3-5 result in a less pronounced tilting movement of needle bar 7 during the needling process.

The embodiment of the drive mechanism for the needle bar shown in greater detail in FIG. 3 comprises a first oscillating drive 13, which is substantially identical to first oscillating drive 13 of FIG. 2. Second oscillating drive 17 is also substantially identical to second oscillating drive 17 of FIG. 2, and secondary conrod 19 is again connected to main conrod 15 by way of a rotary joint 29. In contrast to the embodiment of the drive mechanism shown in FIG. 2, the forward end of main conrod 15 is connected to needle bar 7 by way of a rotary joint 31. Needle bar 7 is in turn connected rigidly to a guide lever 33, which extends substantially in the vertical direction and is connected at its upper end to a rigid guide rod 37 by way of a rotary joint 35. Guide rod 37 extends substantially in a horizontal direction toward the rear, that is, toward first and second oscillating drives 13, 17. At its other end, guide rod 37 is anchored rotatably in the machine stand 41 by way of another rotary joint 39.

The embodiment of the drive mechanism for needle bar 7 shown in FIG. 4 again comprises a first oscillating drive 13, which is substantially identical to first oscillating drive 13 according to the embodiments of FIGS. 2 and 3. Main conrod 15 is again rigidly connected at its forward end to needle bar 7. In this case, central shaft 43 of first oscillating drive 13 drives an additional eccentric drive 47 by way of a toothed belt 45. The additional drive can again consist of, for example, a crank disk 49 and a crank pin 51. The associated connecting rod 53 extends substantially in the vertical direction and is connected at its upper end to one arm of a rocker arm 57 by way of a rotary joint 55. The center part of rocker arm 57 is supported rotatably in machine stand 41 by another rotary joint 59. On the other end of rocker arm 57, second oscillating drive 17 is rotatably mounted, secondary conrod 19 of which extends downward in a substantially vertical direction and is connected there directly to needle bar 7 by way of a rotary joint 61. Secondary conrod 19 can be actuated in various ways. In the example shown here, it is actuated by means of two interconnected belt drives 63, 65.

In the case of the embodiment of the drive mechanism for needle bar 7 shown in FIG. 5, first oscillating drive 13 is again configured similarly to first oscillating drive 13 in the preceding exemplary embodiments. Main conrod 15 is connected to needle bar 7 in a substantially rigid manner. Second oscillating drive 17 is in this case arranged above needle bar 7 and shifted somewhat rearward toward first oscillating drive 13. Secondary conrod 19 extends again in a substantially vertical direction and is connected at its lower end to a first end of a rocker arm 69 by way of a rotary joint 67, the central part of rocker arm 69 being connected to needle bar 7 by way of an additional rotary joint 71. At the other end of rocker arm 69, an additional auxiliary conrod 73 is connected to rocker arm 69 by way of a rotary joint 75. This auxiliary conrod 73 extends upward in a substantially vertical direction and is part of an additional eccentric auxiliary drive 77, which serves to stabilize the system and to raise needle bar 7 during the return stroke of first oscillating drive 13. In the exemplary case shown here, the rotational direction of crank disk 21 of first oscillating drive 13 is counter to the rotational direction of crank disk 23 of second oscillating drive 17, whereas eccentric auxiliary drive 77 rotates in the same direction as first oscillating drive 13. The stroke of this eccentric auxiliary drive 77, in terms of its absolute value, is between the stroke of first oscillating drive 13 and the stroke of second oscillating drive 17, and the frequency of eccentric auxiliary drive 77 corresponds to the frequency of first oscillating drive 13.

The person skilled in the art will be able to indicate quite a number of additional exemplary embodiments capable of realizing the principle according to the invention. The various structural details and dimensions, angle ratios, lever ratios, drive types, etc, are modifiable in many different ways within the scope of the present invention.

The important point in regard to the selection of the parameters, however, is that (see FIG. 6) a horizontal component (H1) of the center of gravity of needle bar 7 produced by first oscillating drive 13 is at least 25%, preferably at least 50%, and more preferably at least 75% greater than a vertical component (V1) of the center of gravity of needle bar 7 produced by first oscillating drive 13. This guarantees that first oscillating drive 13 specifies a basic form of the path along which the center of gravity of needle bar 7 travels, namely, a path which resembles a horizontal ellipse 79. It is also essential that the geometric relationships are adapted in such a way that a second vertical stroke component (V2) of the center of gravity of needle bar 7 produced by second oscillating drive 17 (see FIG. 7) is at least 20%, preferably at least 30%, and more preferably at least 40% smaller than the vertical stroke component (V1) of the center of gravity of needle bar 7 produced by first oscillating drive 13.

Figure 6:
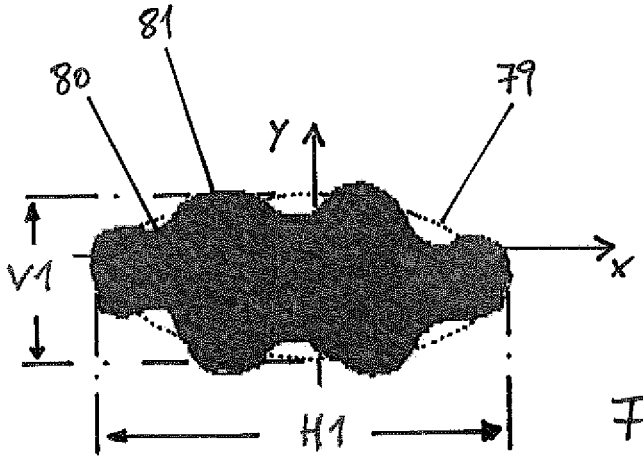
FIG. 6 shows a schematic diagram of a possible curved path for the center of gravity of the needle bar during the use of the method according to the invention.
Figure 7:
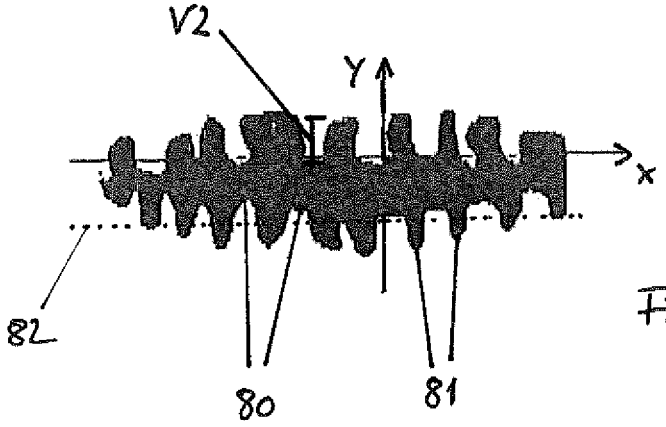
FIG. 7 shows a schematic diagram of another possible curved path for the center of gravity of a needle bar during the use of the method according to the invention in the presence of other parameters, especially in the presence of a higher frequency of the second oscillating drive.

Overall, what is therefore obtained for the center of gravity of needle bar 7 in the course of one stitching cycle is preferably a path which comprises substantially the basic form of the horizontal ellipse 79 with smaller additional sinusoidal peaks 80 and valleys 81 superimposed on it along the long sides. Examples of curves of this type are shown in FIGS. 6 and 7. It is easy to see that the frequency of second oscillating drive 17 in the example of FIG. 6 is approximately three times higher than the frequency of first oscillating (eccentric) drive 13, whereas, to produce the curved path of FIG. 7, the frequency of second oscillating drive 17 must be approximately nine times higher than the frequency of first oscillating (eccentric) drive 13.

The curved path of the center of gravity of needle bar 7 is obviously identical to the curved path which a tip of a needle 11 of needle board 9 arranged in the area of the center of gravity of needle bar 7 will follow. When we view the curved path of FIG. 7 as representing the curved path traveled by the tip of a specific needle 11, then, in the case of the example of FIG. 7, the broken line 82 would represent the position, by way of example, of the fiber fleece. It can be seen that, during the long forward movement in the x direction, that is, in the lower part of the basic elliptical form of the curved path, needle 11 engages in fiber fleece 82 in the area of the sinusoidal peaks 81 and emerges from fiber fleece 82 again in the area of the valleys 80. In contrast, in the area of the return stroke of first oscillating (eccentric) drive 13, that is, in the upper part of the curved elliptical path, needle 11 does not engage in fiber fleece 82 even in the area of valleys 80.

In the method according to the invention, the fiber fleece can be transported through the needling machine 1 at a speed of at least 100 m/min, preferably of at least 200 m/min, and more preferably of at least 300 m/min. The stroke rate of first oscillating drive 13 in the horizontal direction should be substantially the same as the transport speed of the fiber fleece. To achieve a sufficient stitch density, needle board 9 preferably has a needle density of at least 10,000 needles per meter of board length, preferably of at least 15,000 needles per meter of board length, and more preferably of at least 20,000 needles per meter of board length. This unit, which is used by convention in the industry in question, is based on the assumption that the needle board has a width in the range of 250-400 mm.

Overall, the method according to the invention makes possible a very high transport speed of the fiber fleece web without causing any major sacrifice in terms of the density of the stitches in the fiber fleece web.

The invention claimed is:

1. A method for actuating a needle bar in a needling machine comprising the steps of:

actuating a first oscillating drive at a first frequency, the first oscillating drive including a main conrod connected directly or indirectly to the needle bar and oriented substantially in a horizontal direction; and simultaneously actuating a second oscillating drive at a second frequency higher than the first frequency, the second oscillating drive including a secondary conrod connected directly or indirectly to the needle bar in such a way that movements of the needle bar produced by the first and second oscillating drives are superimposed on each other.

2. The needle bar actuating method of claim 1 wherein the first frequency is in the range of 500-2,500 strokes per minute.

3. The needle bar actuating method of claim 1 wherein the second oscillating drive is an eccentric drive.

4. The needle bar actuating method of claim 1 wherein the second frequency is in the range of 2,000-10,000 strokes per minute.

5. A method for actuating a needle bar in a needling machine comprising the steps of:

actuating a first oscillating eccentric drive at a first frequency, the first oscillating eccentric drive including a main conrod connected directly or indirectly to the needle bar, a horizontal stroke component of a center of gravity of the needle bar produced by the first oscillating drive being at least 25% greater than a vertical stroke component of a center of gravity of the needle bar produced by the first oscillating drive; and simultaneously actuating a second oscillating drive at a second frequency higher than the first frequency, the second oscillating drive including a secondary conrod connected directly or indirectly to the needle bar in such a way that movements of the needle bar produced by the first and second oscillating drives are superimposed on each other.

6. The needle bar actuating method of claim 5 wherein the horizontal stroke component of the center of gravity of the needle bar produced by the first oscillating drive is at least 50% greater than the vertical stroke component of the center of gravity of the needle bar produced by the first oscillating drive.

7. A method for actuating a needle bar in a needling machine comprising the steps of:

actuating a first oscillating drive at a first frequency, the first oscillating drive including a main conrod connected directly or indirectly to the needle bar; and simultaneously actuating a second oscillating drive at a second frequency higher than the first frequency, the second oscillating drive including a secondary conrod oriented in substantially the vertical direction and connected directly or indirectly to the needle bar in such a way that movements of the needle bar produced by the first and second oscillating drives are superimposed on each other.

8. A method for actuating a needle bar in a needling machine comprising the steps of:

actuating a first oscillating drive at a first frequency, the first oscillating drive including a main conrod connected directly or indirectly to the needle bar; and simultaneously actuating a second oscillating drive at a second frequency higher than the first frequency, the second oscillating drive including a secondary conrod connected directly or indirectly to the needle bar in such a way that movements of the needle bar produced by the first and second oscillating drives are superimposed on each other, a second vertical stroke component of a center of gravity of the needle bar produced by the second oscillating drive being at least 20% smaller than a first vertical stroke component of a center of gravity of the needle bar produced by the first oscillating drive.

9. A method for actuating a needle bar in a needling machine comprising the steps of:

actuating a first oscillating drive at a first frequency, the first oscillating drive including a main conrod connected directly or indirectly to the needle bar;

simultaneously actuating a second oscillating drive at a second frequency higher than the first frequency, the second oscillating drive including a secondary conrod connected directly or indirectly to the needle bar in such a way that movements of the needle bar produced by the first and second oscillating drives are superimposed on each other; and wherein, over the course of one stitching cycle, a center of gravity of the needle bar follows a path substantially in the form of a horizontal ellipse with smaller additional sinusoidal peaks and valleys superimposed on it along long sides of the ellipse.

10. A method for operating a needling machine comprising the steps of:

actuating a first oscillating drive at a first frequency, the first oscillating drive including a main conrod connected directly or indirectly to a needle bar of the needling machine and oriented substantially in a horizontal direction;

simultaneously actuating a second oscillating drive at a second frequency higher than the first frequency, the second oscillating drive including a secondary conrod connected directly or indirectly to the needle bar in such a way that movements of the needle bar produced by the first and second oscillating drives are superimposed on each other; and transporting a card web or fleece through the needling machine at a speed of at least 100 m/min.

11. The needling machine operating method of claim 10 wherein the step of transporting of the card web or fleece through the needling machine includes transporting the card web or fleece at a speed of at least 200 m/min.

12. The needling machine operating method of claim 10 wherein a needle board attached to the needle bar has a needle density of at least 15,000 needles per meter of board length.

13. The needling machine operating method of claim 10 wherein the step of transporting the card web or fleece through the needling machine is accomplished by a brush belt on which the card web or fleece rests.

14. The needling machine operating method of claim 12 wherein the card web or fleece transported through the needling machine is held down by wires stretched over the brush belt during needling.

* * * * *